United States Patent [19]

Rondot et al.

[11] Patent Number: 4,928,814

[45] Date of Patent: May 29, 1990

[54] PAD ENCLOSURE

[75] Inventors: Klaus Rondot, Düsseldorf; Jörg Schlichting, Neuss, both of Fed. Rep. of Germany

[73] Assignee: Minnesota Mining & Manufacturing Comp., St. Paul, Minn.

[21] Appl. No.: 44,234

[22] Filed: Apr. 30, 1987

[51] Int. Cl.[5] ..... B65D 85/00

[52] U.S. Cl. ..... 206/215; 206/447; 206/449; 206/460

[58] Field of Search ..... 206/96, 101, 102, 103, 206/104, 119, 215, 232, 38, 447, 449, 460, 813

[56] References Cited

U.S. PATENT DOCUMENTS

| | | | |
|---|---|---|---|
| 2,234,276 | 3/1941 | Redcliffe | 206/103 |
| 3,358,817 | 12/1967 | Will | 206/103 |
| 4,015,708 | 4/1977 | Kelm | 206/460 |
| 4,640,411 | 2/1987 | Fery | 206/449 |
| 4,713,274 | 12/1987 | Minor | 206/813 |
| 4,746,018 | 5/1988 | Mueller | 206/447 |

FOREIGN PATENT DOCUMENTS

| | | | |
|---|---|---|---|
| 855557 | 11/1970 | Canada | 206/103 |

*Primary Examiner*—David T. Fidei

[57] ABSTRACT

An enclosure for a pad of paper sheets including a rectangular elongate sheet of stiff paper material bent at scores to define bottom, front, top and rear portions adapted to respectively overlie the bottom, front, top, and rear surfaces of the pad; and structure providing a recess at the end of the rear portion adapted to frictionally and removably receive a triangular end part of the sheet projecting from its bottom portion to close the enclosure.

13 Claims, 3 Drawing Sheets

PAD ENCLOSURE

TECHNICAL FIELD

The present invention relates to protective enclosures for pads of material such as notepaper. Disclosure of the

DISCLOSURE OF THE INVENTION

The present invention provides an enclosure for pads of material such as note paper that can be easily opened to remove a sheet from the pad, protects the pad when it is being carried, for example, in a handbag or briefcase, and may be decorated to enhance the aesthetics of the enclosure.

According to the present invention there is provided an enclosure for a pad of sheets, which enclosure comprises a rectangular elongate sheet of stiff paper material having spaced transverse scores and being bent at the scores to define sequentially along the length of the sheet an end portion, a bottom portion adapted to overlie and be coextensive with a bottom surface of the pad, a front portion adapted to overlie and be coextensive with a front surface of the pad, a top portion adapted to overlie and to be coextensive with a top surface of the pad, a rear portion adapted to overlie and to be coextensive with a rear surface of the pad, and two additional portions of the sheet defining a recess opening at the end of the rear portion opposite the top portion adapted to frictionally and removably receive the end portion to close the enclosure. The enclosure can be easily opened by pulling the end portion of the sheet from the recess and pivoting the front portion away from the front of the pad to afford access to it, for example to write a note or remove a sheet; and can as easily be again closed by pivoting the front portion back over the front of the pad and reinserting the end portion of the sheet into the recess.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 1:
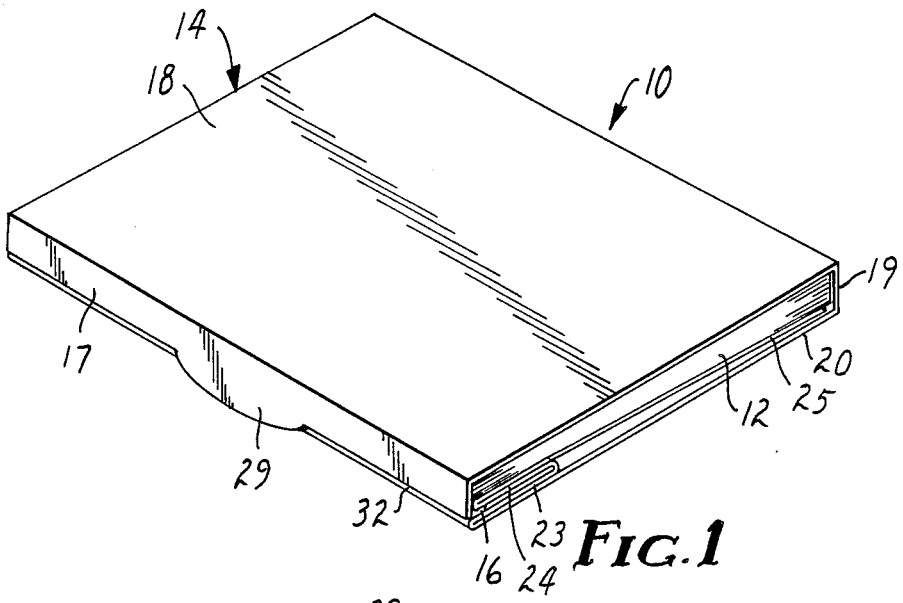
FIG. 1 is a perspective view of the closed enclosure according to the present invention shown closed around a note pad.

Referring now to the drawing there is shown an enclosure according to the present invention generally designated by the reference numeral 10.

Figure 3:
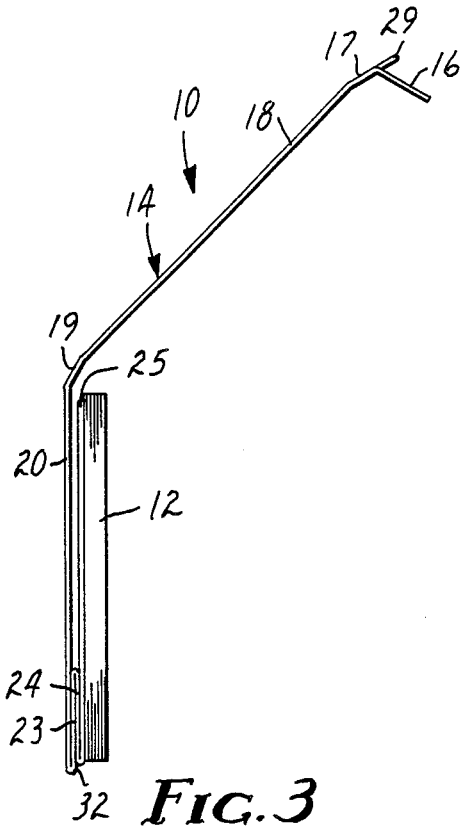
FIG. 3 is an end view of the enclosure and note pad of FIG. 1 shown with the enclosure open.
Figure 2:
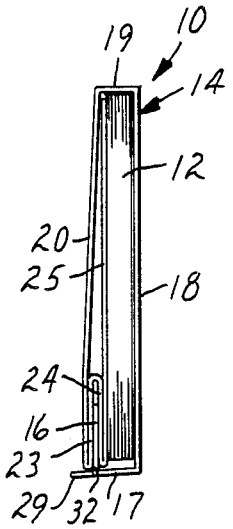
FIG. 2 is an end view of the closed enclosure and note pad of FIG. 1.
Figure 4:
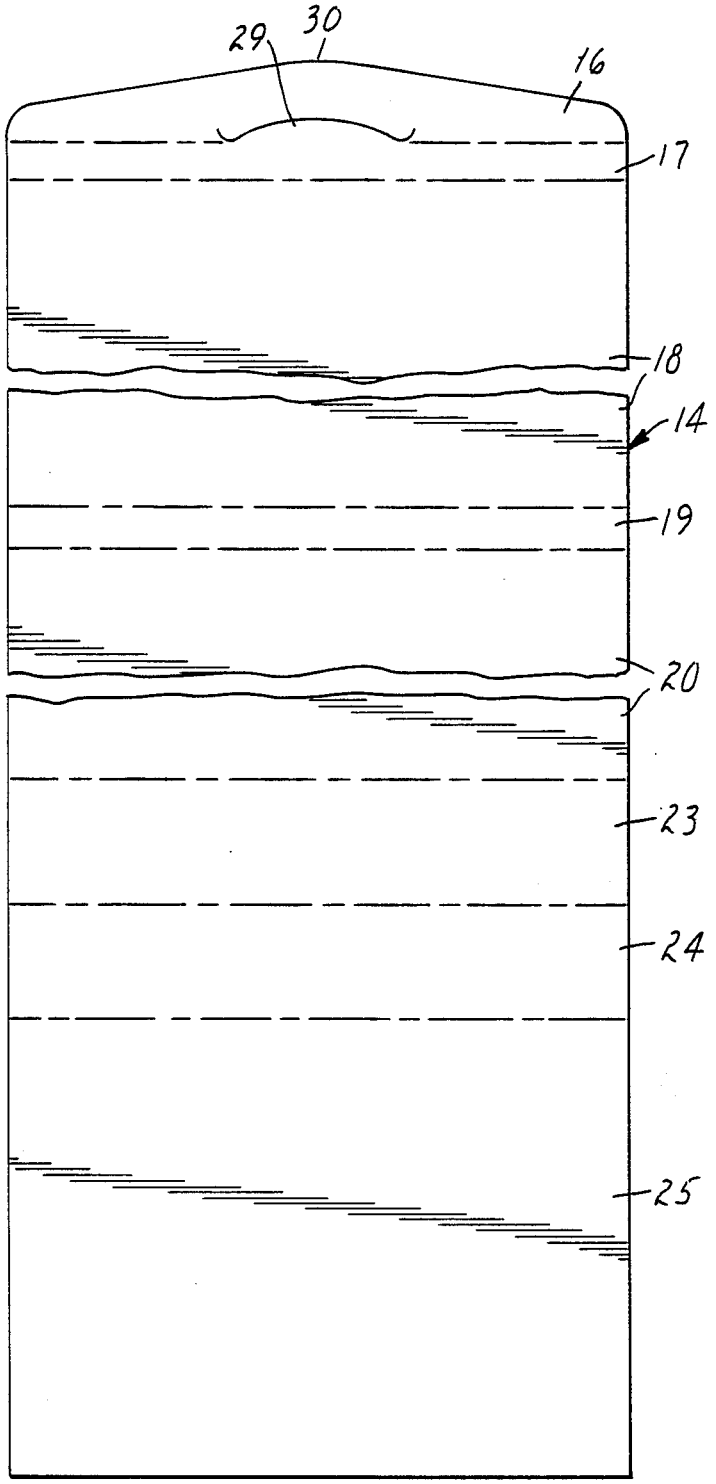
FIG. 4 is a plane view of a sheet from which the enclosure of FIG. 1 is formed.
Figure 5:
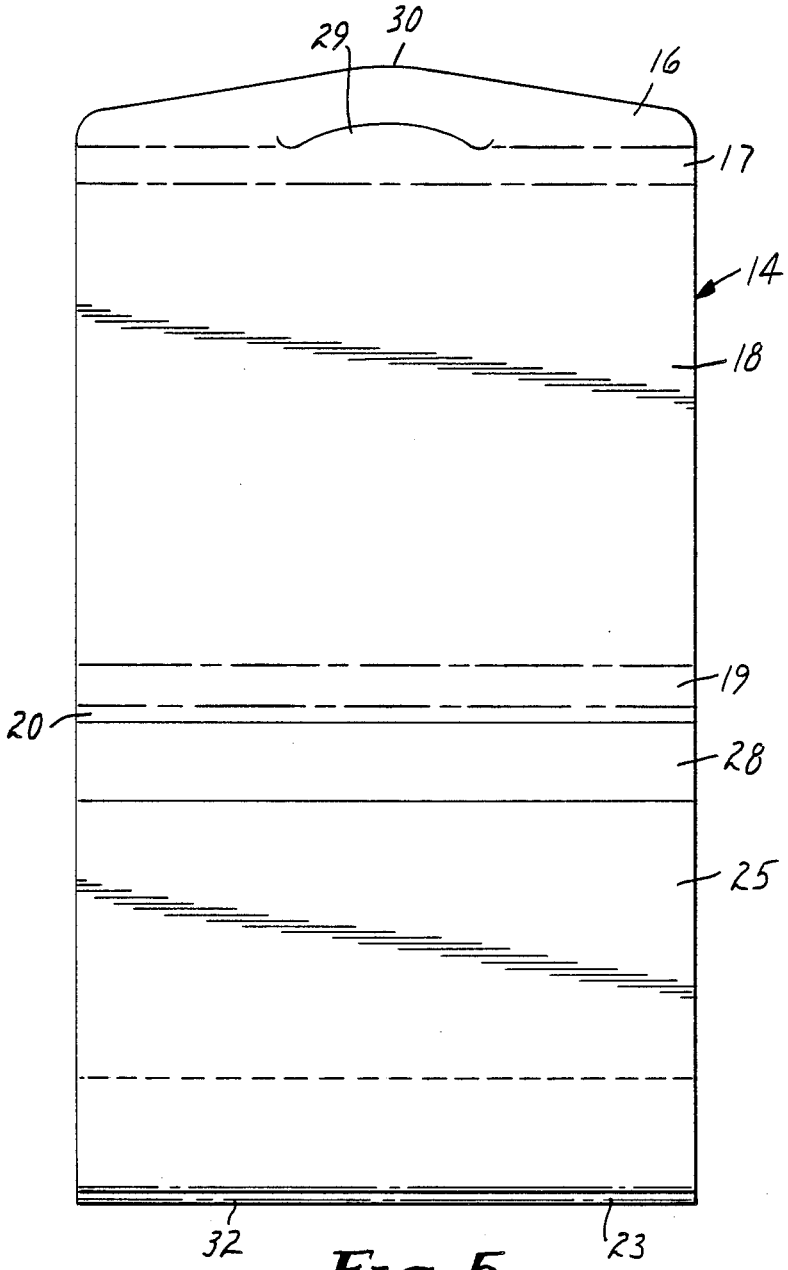
FIG. 5 is an enlarged plan view of the enclosure of FIG. 1 shown with the pad removal and the enclosure open.

The enclosure 10 is adapted to cover front, rear, top and bottom surfaces of a pad 12 of paper sheets adhered together by pressure sensitive adhesive on the back surfaces of the sheets (e.g. a pad 12 of the type commercially designated Scotch Brand "Post-it" TM Note Pad available from Minnesota Mining and Manufacturing Company, St. Paul, Minn.). The enclosure 10 is made from a rectangular elongate sheet 14 of stiff paper material shown in FIG. 4, which sheet 14 has spaced transverse scores and is bent at the scores as is best seen in FIGS. 2 and 3 to define sequentially along the length of the sheet 14 a generally right rectangular end portion 16 (see FIG. 5), a bottom portion 17 adapted to overlie and be coextensive with the bottom surface of the pad 12, a front portion 18 adapted to overlie and be coextensive with the front surface of the pad 12, a top portion 19 adapted to overlie and be coextensive with the top surface of the pad 12, a rear portion 20 adapted to overlie and be coextensive with the rear surface of the pad 12, outer and inner recess forming portions 23 and 24, and a liner portion 25. The outer recess-forming portion 23 is generally parallel to and along the surface of the rear portion 20 adapted to be adjacent the pad 12, the inner recess-forming portion 24 is slightly shorter than, parallel to, and along the surface of the outer recess-forming portion 23 adapted to be adjacent the pad 12, and the liner portion 25 extends parallel to and along and past the surface of the inner recess-forming portion 24 opposite the front portion 20. The front, recess-forming and liner portions 20, 23, 24, and 25 are attached together (as by adhesive) adjacent the joined ends of the recess-forming portions 23 and 24 to both define a recess between the recess-forming portions 23 and 24 opening along the adjacent end of the rear portion 20 adapted to frictionally and removably receive the triangular end portion 16 of the sheet 14 tip first to close the enclosure 10 and to adhere the recess-forming portions 23 and 24 to the rear and liner portions 20 and 25 and maintain the end portions 20, 23, 24 and 25 in a generally parallel relationship. At least some of the portions may have decorative outer surfaces.

Preferably the enclosure 10 includes means for affording the attachment of a pressure sensitive adhesive coated rear surface of the pad 12 to the liner portion 25 of the sheet 14, which means, as illustrated, is a part 28 of the liner portion 25 adjacent the top portion 19 of the sheet 14 that has a surface particularly adapted to be adhered to by the adhesive.

When the enclosure 10 is closed around the pad 12 as is shown in FIGS. 1 and 2, the top and bottom portions 19 and 17 are disposed at about a right angle with respect to the front and rear portions 18 and 20. The enclosure 10 can be easily opened, however, by pulling the end portion 16 from the recess and pivoting the front portion 18 away from the front of the pad 12 to afford access to the pad 12 to write a note on or remove a sheet from the pad 12, which removal of the end portion 16 is facilitated by an arcuate tab 29 centrally projecting from the side of the bottom portion 17 adjacent the end portion 16 and formed by an arcuate cut in the sheet 14 that has its ends on the score between the bottom and end portions 17 and 16. The tab 29 projects past the outer surface of the rear portion 20 where it can be engaged by a user's fingers to initiate removal of the end portion 16. The enclosure 10 can as easily be again closed by pivoting the front portion 18 back over the front of the pad 12 and reinserting the end portion 16 into the recess. A central rounded point 30 on the distal end of the triangular end portion 16 makes it easy to insert the end portion 16 into the recess, and the outer recess forming portion 23 projects slightly (e.g., about 0.16 centimeter) past the inner recess forming portion 24 to form a ledge 32 along the outer recess forming portion 23 that helps direct the rounded point 30 into the recess. The tab 29 then forms a stop to show full engagement of the end portion 16 with the recess.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

We claim:

1. An enclosure for a pad of sheets having front, rear, top and bottom surfaces with said front and rear surfaces being substantially larger than said top and bottom surfaces, said enclosure comprising a rectangular elongate sheet of stiff paper material, said paper material having spaced transverse scores and being bent at said scores to define sequentially along the length of said sheet an end portion, a bottom portion adapted to overlie and be coextensive with the bottom surface of the pad, a front portion substantially larger than said end and bottom portions adapted to overlie and be coextensive with the front surface of the pad, a top portion of about the same size as said bottom portion adapted to overlie and be coextensive with the top surface of the pad, a rear portion of about the same size as said front portion adapted to overlie and be coextensive with the rear surface of the pad, and outer and inner recess-forming portions, said outer recess-forming portion being generally parallel to and along the surface of said rear portion adapted to be adjacent the pad and said inner recess-forming portion being parallel to and along the surface of the outer recess-forming portion adapted to be adjacent the pad, said rear portion and said recess-forming portions being attached together adjacent the score between said outer and inner recess-forming portions to define a recess between said outer and inner recess-forming portions opening along the adjacent end of said rear portion which recess is adapted to frictionally and removably receive said end portion to close said enclosure.

2. An enclosure according to claim 1 wherein at least some of said portions have decorative outer surfaces.

3. An enclosure according to claim 1 wherein said end portion is generally right triangular and has a central rounded distal end.

4. An enclosure according to claim 1 wherein said sheet includes a tab centrally projecting from the side of said bottom portion adjacent said end portion, said tab projecting past the surface of said rear portion opposite said recess forming portions when said end portion is engaged in said recess.

5. An enclosure according to claim 1 wherein said sheet further includes a liner portion at the end of said inner recess-forming portion opposite said outer recess-forming portion, said liner portion being generally parallel to and extending along and past the surface of said inner recess-forming portion opposite said outer recess-forming portion and being attached to said inner recess-forming portion adjacent the score between said recess forming portions, and wherein an end part of said liner portion opposite said inner recess-forming portion is adapted to have the pad adhered thereto.

6. An enclosure according to claim 1 wherein said inner recess-forming portion is shorter than said outer recess-forming portion to provide a guide lip at the end of said outer recess-forming portion adjacent said rear portion that helps guide said end portion into said recess.

7. An enclosure for a pad of sheets having front, rear, top and bottom surfaces with said front and rear surfaces being substantially larger than said top and bottom surfaces, said enclosure comprising a rectangular elongate sheet of stiff paper material, said paper material having spaced transverse scores and being bent at said scores to define sequentially along the length of said sheet a generally right triangular end portion having a central rounded distal end, a bottom portion adapted to overlie and be coextensive with the bottom surface of the pad, a front portion substantially larger than said end and bottom portions adapted to overlie and be coextensive with the front surface of the pad, a top portion of about the same size as said bottom portion adapted to overlie and be coextensive with the top surface of the pad, a rear portion of about the same size as said front portion adapted to overlie and be coextensive with the rear surface of the pad, outer and inner recess-forming portions and a liner portion, said outer recess-forming portion being generally parallel to and along the surface of said rear portion adapted to be adjacent the pad, said inner recess-forming portion being parallel to and along the surface of the outer recess-forming portion adapted to be adjacent the pad and said liner portion extending parallel to and along and past the surface of said inner recess-forming portion opposite said rear portion with said rear, recess-forming and liner portions being attached together adjacent the score between said outer and inner recess-forming portions to define a recess between said outer and inner recess-forming portions opening along the adjacent end of said rear portion adapted to frictionally and removably receive said end portion to close said enclosure, an end part of said liner portion opposite said inner recess-forming portion being adapted to have the pad adhered thereto, said inner recess-forming portion being shorter than said outer recess-forming portion to provide a guide lip at the end of said outer recess-forming portion adjacent said rear portion that helps guide said end portion into said recess, and said sheet including a tab centrally projecting from the side of said bottom portion adjacent said end portion, said tab projecting past the surface of said rear portion opposite said recess forming portions when said end portion is engaged in said recess.

8. In combination, a pad of sheets having front, rear, top and bottom surfaces with said front and rear surfaces being substantially larger than said top and bottom surfaces, and an enclosure comprising a rectangular elongate sheet of stiff paper material, said paper material having spaced transverse scores and being bent at said scores to define sequentially along the length of said sheet an end portion, a bottom portion overlying and coextensive with the bottom surface of the pad, a front portion substantially larger than said end and bottom portions overlying and coextensive with the front surface of the pad, a top portion of about the same size as said bottom portion overlying and coextensive with the top surface of the pad, a rear portion of about the same size as said front portion overlying and coextensive with the rear surface of the pad, and outer and inner recess-forming portions, said outer recess-forming portion being generally parallel to and along the surface of said rear portion adjacent the pad and said inner recess-forming portion being parallel to and along the surface of the outer recess-forming portion adjacent the pad, said rear portion and said recess-forming portions being attached together adjacent the score between said outer and inner recess-forming portions to define a recess between said outer and inner recess-forming portions opening along the adjacent end of said rear portion, said recess frictionally and removably receiving said end portion to close said enclosure.

9. A combination according to claim 8 wherein at least some of said portions have decorative outer surfaces.

10. A combination according to claim 8 wherein said end portion is generally right triangular and has a central rounded distal end.

11. A combination according to claim 8 wherein said sheet includes a tab centrally projecting from the side of said bottom portion adjacent said end portion, said tab projecting past the surface of said rear portion opposite said recess forming portions when said end portion is engaged in said recess.

12. A combination according to claim 8 wherein said sheet further includes a liner portion at the end of said inner recess-forming portion opposite said outer recess-forming portion, said liner portion being generally parallel to and extending along and past the surface of said inner recess-forming portion opposite said outer recess-forming portion and being attached to said inner recess-forming portion adjacent the score between said recess forming portions, and wherein said pad is adhered to an end part of said liner portion opposite said inner recess-forming portion.

13. A combination according to claim 8 wherein said inner recess-forming portion is shorter than said outer recess-forming portion to provide a guide lip at the end of said outer recess-forming portion adjacent said rear portion that helps guide said end portion into said recess.

* * * * *